United States Patent [19]

Nanyoshi et al.

[11] Patent Number: 4,941,442

[45] Date of Patent: Jul. 17, 1990

[54] APPARATUS FOR CONTROLLING FUEL DELIVERY TO ENGINE

[75] Inventors: Yasutoshi Nanyoshi; Tatsuo Morita, both of Kanagawa, Japan

[73] Assignee: Nissan Motor Co., Ltd., Japan

[21] Appl. No.: 195,300

[22] Filed: May 18, 1988

[30] Foreign Application Priority Data

May 20, 1987 [JP] Japan ..... 62-124714

[51] Int. Cl.[5] ..... F02D 17/02; F02D 41/22

[52] U.S. Cl. ..... 123/333; 123/481

[58] Field of Search ..... 123/333, 332, 481, 198 F

[56] References Cited

U.S. PATENT DOCUMENTS

| | | | |
|---|---|---|---|
| 4,129,109 | 12/1978 | Matsumoto | 123/481 |
| 4,134,261 | 1/1979 | Iizuka et al. | 60/276 |
| 4,353,342 | 10/1982 | Sugasawa et al. | 123/493 |
| 4,473,045 | 9/1984 | Bolander et al. | 123/198 F |
| 4,550,704 | 11/1985 | Barho et al. | 123/481 |

FOREIGN PATENT DOCUMENTS

| | | | |
|---|---|---|---|
| 61-55323 | 3/1986 | Japan | 123/198 F |
| 1582464 | 1/1981 | United Kingdom . | |
| 2092777 | 8/1982 | United Kingdom . | |
| 2122682 | 1/1984 | United Kingdom . | |

*Primary Examiner*—Andrew M. Dolinar

*Attorney, Agent, or Firm*—Leydig, Voit & Mayer

[57] ABSTRACT

An apparatus for controlling a multi-cylinder type internal combustion engine including first and second cylinder groups each includinhg at least one cylinder. The apparatus comprises sensors for generating electrical signals indicative of engine operating conditions including engine speed, and a control circuit coupled to the sensors for determining an appropriate value repetitively at uniform intervals. This calculation is made according to the engine operating conditions. A fuel supply device is coupled to the control circuit for supplying fuel to the first and second cylinder groups in an amount corresponding to the calculated value. The control circuit operates the fuel supply device to alternatively terminate the fuel delivery to the first cylinder group and the fuel delivery to the second cylinder group under an overspeed condition.

6 Claims, 6 Drawing Sheets

APPARATUS FOR CONTROLLING FUEL DELIVERY TO ENGINE

BACKGROUND OF THE INVENTION

This invention relates to a fuel delivery control apparatus for use with a multi-cylinder type internal combustion engine and, more particularly, to a fuel delivery control apparatus for terminating fuel delivery to some of the cylinders of the engine to avoid overspeed at high engine speeds.

Generally, it is the current practice to avoid engine overspeed by terminating fuel delivery to the engine operating at high speeds. For example, Japanese Patent Kokai No. 81-55323 discloses a fuel delivery control apparatus for operating an engine in a fuelcut mode to terminate fuel delivery to a a preselected cylinder group when the engine speed exceeds a predetermined value.

A disadvantage with such a conventional fuel delivery control apparatus is that the life of the engine is limited because of mechanical stresses caused by the temperature differences between the preselected cylinder group and the other cylinder group in the fuelcut mode of operation of the engine. In addition, the components associated with the preselected cylinder group will wear in a relatively shorter time than the components associated with the other cylinder group. Since the fuel delivery to the preselected cylinder group is terminated frequently, the combustion of the air-fuel mixture becomes unstable in the preselected cylinder group, resulting in emission of unburned fuel components therefrom. On the other hand, the other cylinders discharge hot exhaust gases which are mixed with the unburned fuel components discharged from the preselected cylinders to increase the exhaust gas temperature to a great extent causing a breakdown of the catalytic converter located in the exhaust passage of the engine when the fuelcut mode continues for a long period of time.

SUMMARY OF THE INVENTION

It is, therefore, a main object of the invention to provide an improved fuel delivery control apparatus which is free from the above disadvantages associated with conventional apparatus.

There is provided, in accordance with the invention, an apparatus for controlling a multi-cylinder type internal combustion engine including first and second cylinder groups each having at least one cylinder. The apparatus comprises sensor means for generating electrical signals indicative of engine operating conditions including engine speed, and a control circuit coupled to the sensor means for determining an appropriate value repetitively at uniform intervals of rotation of the engine. This calculation is made according to the engine operating conditions. Means is coupled to the control circuit for supplying fuel to the first and second cylinder groups in an amount corresponding to the calculated value. The control circuit includes means responsive to an overspeed condition for operating the fuel supply means to alternatively terminate the fuel delivery to the first cylinder group and the fuel delivery to the second cylinder group.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
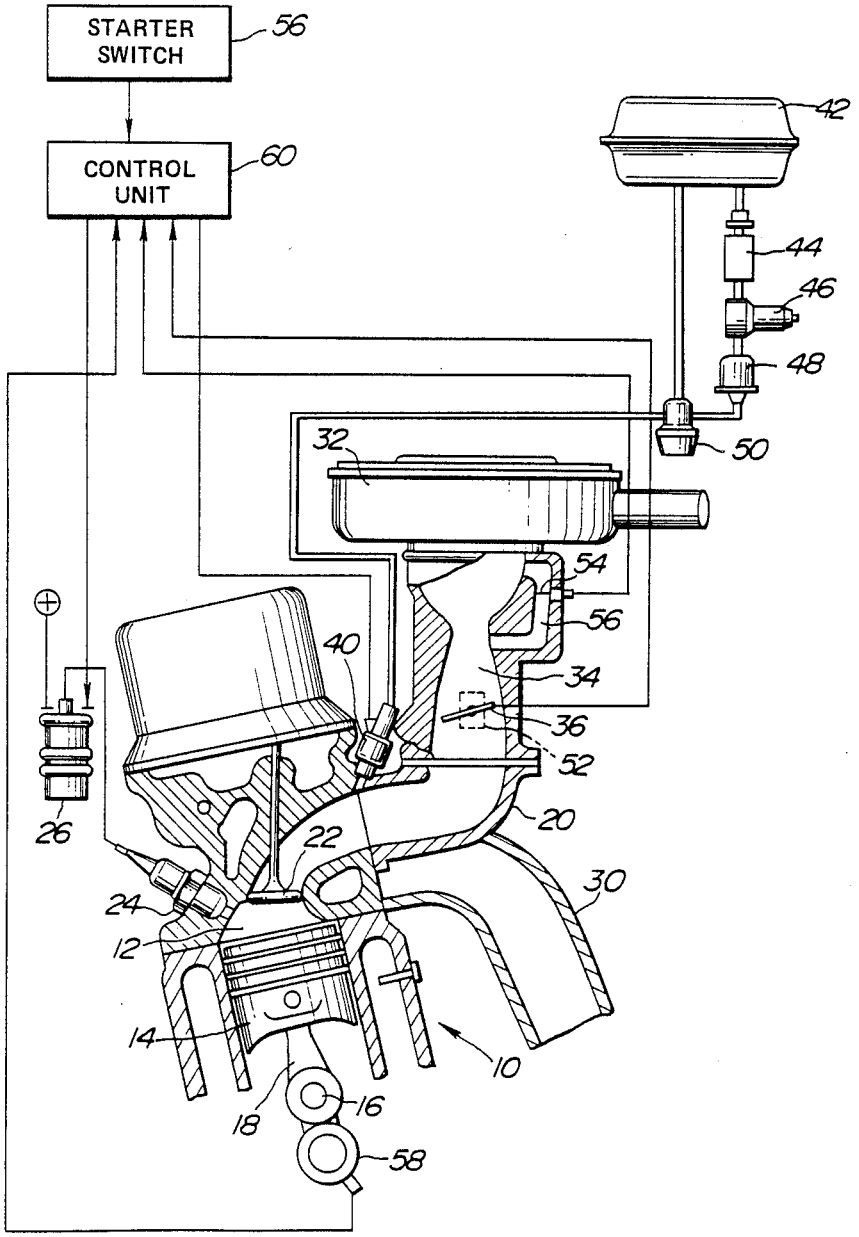
FIG. 1 is a schematic diagram showing one embodiment of a fuel delivery control apparatus made in accordance with the present invention.

With reference to the drawings, and in particular to FIG. 1, there is shown a schematic diagram of a fuel delivery control apparatus embodying the invention. An internal combustion engine, generally designated by the numeral 10, for an automotive vehicle includes a combustion chamber or cylinder 12. A piston 14 is mounted for reciprocal motion within the cylinder 12. A crankshaft 16 is supported for rotation within the engine 10. Pivotally connected to the piston 14 and the crankshaft 16 is a connecting rod 18 used to produce rotation of the crankshaft 16 in response to reciprocation of the piston 14 within the cylinder 12.

An intake manifold 20 is connected with the cylinder 12 through an intake port with which an intake valve 22 is in cooperation for regulating an entry of combustion ingredients into the cylinder 12 from the intake manifold 20. A spark plug 24 is mounted in the top of the cylinder 12 for igniting the combustion ingredients within the cylinder 12 when the spark plug 24 is energized by the presence of high voltage electrical energy from an ignition coil 26. An exhaust manifold 30 is connected with the cylinder 12 through an exhaust port with which an exhaust valve is in cooperation for regulating the exit of combustion products, exhaust gases, from the cylinder 12 into the exhaust manifold 20. The intake and exhaust valves are driven through a suitable linkage with the crankshaft 16.

Air to the engine 10 is supplied through an air cleaner 32 into an induction passage 34. The amount of air permitted to enter the combustion chamber 12 through the intake manifold 20 is controlled by a butterfly throttle valve 36 situated within the induction passage 34. The throttle valve 36 is connected by a mechanical linkage to an accelerator pedal. The degree of rotation of the throttle valve 36 is manually controlled by the operator of the engine control system.

A fuel injector 40 is connected to a fuel supply system when includes a fuel tank 42, a fuel pump 44, a fuel damper 46, a fuel filter 48, and a pressure regulator 50. The fuel pump 44 is electrically operated and is capable of maintaining sufficient pressure. The fuel damper 46 attenuates the fuel pressure to an extent. The fuel filter 48 prevents any contaminants from reaching the fuel injector 40. The pressure regulator 50 maintains the pressure differential across the fuel injector 40 at a constant level. This regulation is accomplished by a variation in the amount of excess fuel returned by the regulator 50 to the fuel tank 42. The fuel injector 40 opens to inject fuel toward the intake port of the cylinder 12 when it is energized by the pressure of electrical current. The length of the electrical pulse, that is, the pulse-width, applied to the fuel injector 40 determines the length of time the fuel injector opens and, thus, determines the amount of fuel injected toward the intake port of the cylinder 12.

In the operation of the engine 10, fuel is injected through the fuel injector 40 toward the intake port of the cylinder 12 and mixes with the air therein. When the intake valve opens, the air-fuel mixture enters the combustion chamber 12. An upward stroke of the piston 14 compresses the air-fuel mixture, which is then ignited by a spark produced by the spark plug 24 in the combustion chamber 12. Combustion of the air-fuel mixture in the combustion chamber 12 takes place, releasing heat energy, which is converted into mechanical energy upon the power stroke of the piston 14. At or near the end of the power stroke, the exhaust valve opens and the exhaust gases are discharged into the exhaust manifold 30.

Although the engine 10 as illustrated in FIG. 1 has only one combustion chamber 12 formed by a cylinder and piston, it should be understood that the engine control system described here is equally applicable to a multi-cylinder engine. Thus, it should be understood that a four-cylinder engine has four cylinders, four intake valves, four exhaust valves, four reciprocating pistons, four fuel injectors and four spark plugs to ignite the air-fuel mixture within the combustion chambers and that a six-cylinder engine has six cylinders, six intake valves, six exhaust valves, six reciprocating pistons, six fuel injectors and six spark plugs to ignite the air-fuel mixture within the combustion chambers. It should also be understood that the engine control system described here is equally applicable to a multi-cylinder engine having a plurality of fuel injectors arranged to be actuated singly or in groups of varying numbers in a sequential fashion as well as simultaneously.

The amount of fuel metered to the engine, this being determined by the width of the electrical pulses applied to the fuel injector 40, the fuel-injection timing, and the ignition-system spark timing are repetitively determined from calculations performed by a digital computer, these calculations being based upon various conditions of the engine that are sensed during its operation. These sensed conditions include throttle position, intake air flow, and engine speed. Thus, a throttle position sensor 52, a flow meter 54, a starter switch 56 and a crankshaft position sensor 58 are connected to a control unit 60.

The throttle position sensor 52 includes a potentiometer electrically connected in a voltage divider circuit for supplying a voltage proportional to throttle-valve position. The flow meter 54 comprises a thermosensitive wire placed in a bypass passage 34*a* provided for the induction passage 34 upstream of the throttle valve 36. The starter switch 56 closes to supply current from the engine battery to the control unit 60 when the engine is starting. The crankshaft position sensor 58 produces a series of crankshaft position electrical pulses C1 each corresponding to one degree of rotation of the engine crankshaft and a series of reference electrical pulses Ca at a predetermined number of degree before the top dead center position of each engine piston.

Except under certain speed operating conditions, the fuel-injection pulse-width is calculated as a function of engine speed, intake air flow, ambient temperature, and engine-coolant temperature. The exceptions occur where the engine is being cranked, where its speed exceeds a predetermined upper limit (fuelcut speed), where the engine is idling, and where the engine is decelerating. If the engine operation is not within one of these exceptional regions, then the control unit 60 repetitively calculates an appropriate value for fuel delivery requirement using the sensed engine conditions. The control unit 60 generates fuel injection pulses having the calculated pulse width. The fuel injection pulses supplied to drive the fuel injectors 40 are issued at intervals of a predetermined number of degrees of rotation of the engine crankshaft at which fuel injection is to be initiated by the energization of the respective fuel injectors.

The control unit 60 calculates a difference of a predetermined upper limit (fuelcut speed) from the existing engine speed and it determines an overspeed condition when the calculated difference is greater than zero. Under the overspeed condition, the control unit 60 determines a first interval during which fuel delivery to a first group of cylinders is terminated according to the calculated difference and a second interval during which fuel delivery to a second group of cylinders is terminated according to the calculated difference. The control unit 60 produces no fuel injection pulse to the fuel injectors associated with the first cylinder group during the first interval. The control unit 60 produces no fuel injection pulse to the fuel injectors associated with the second cylinder group during the second interval. The second interval is shifted with respect to the first interval. Thus, the fuel delivery to the first and second cylinder groups are terminated alternatively under the overspeed condition. The control circuit sets the first and second intervals at a first value when the calculated difference is equal to or less than a predetermined first value and at a second value greater than the first value when the calculated difference is greater than the predetermined first value. The control circuit produces no fuel injection pulse to terminate the fuel delivery to both of the first and second cylinder groups when the calculated difference is greater than a predetermined second value greater than the predetermined first value.

Figure 2:
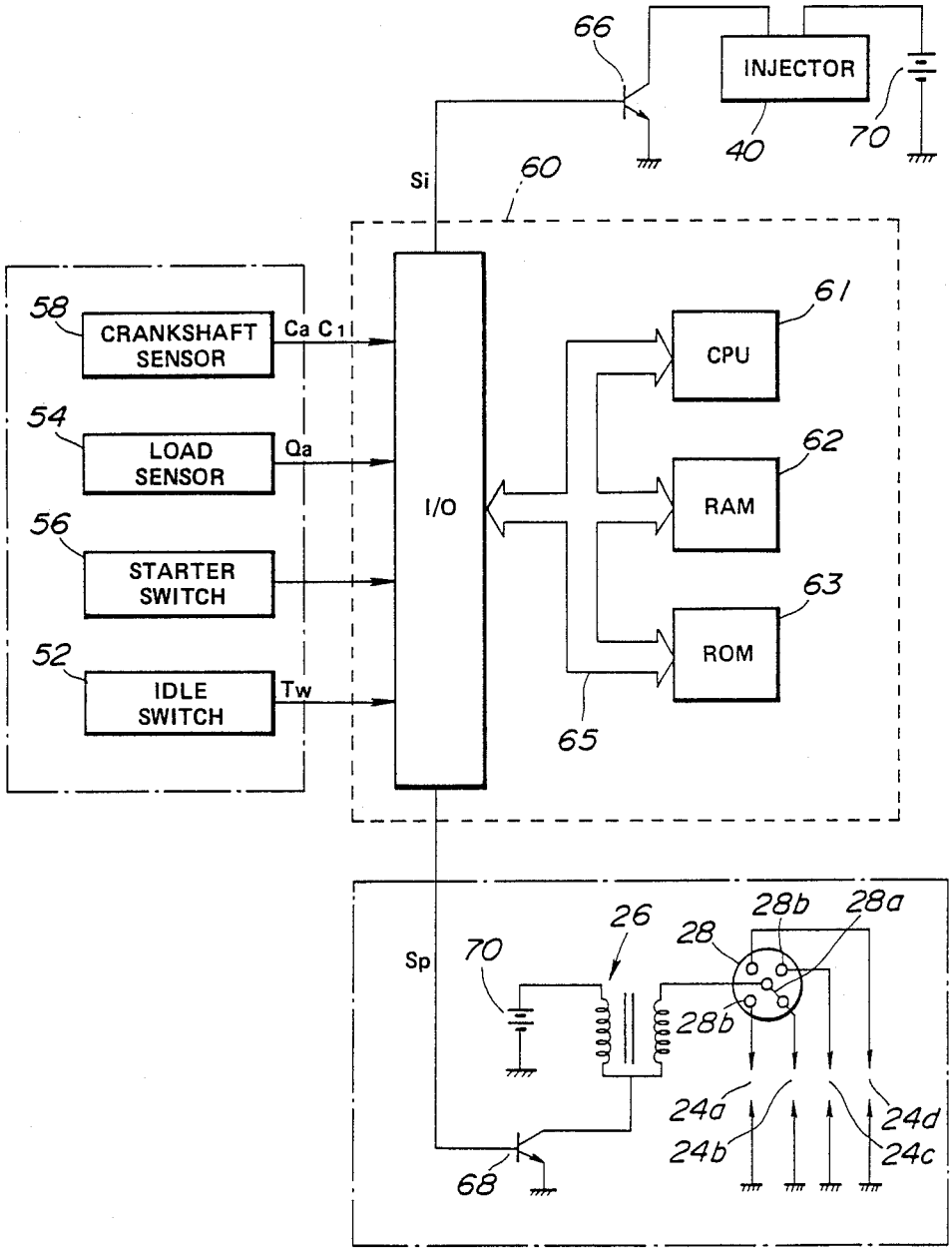
FIG. 2 is a block diagram of the control unit used in the apparatus of FIG. 1.

Referring to FIG. 2, the control unit 60 comprises a digital computer which includes a central processing unit (CPU) 61, a random access memory (RAM) 62, a read only memory (ROM) 63, and an input/output control circuit (I/O) 64. The central processing unit 61 communicates with the rest of the computer via data bus 65. The input/output control circuit 64 includes a counter which counts the reference pulses Ca fed from the crankshaft position sensor 58 and converts its count into an engine speed indication digital signal for application to the central processing unit 61. The input/output control circuit 64 also includes an analog-to-digital converter which receives analog signals from the flow meter 54, and other sensors and converts them into digital form for application to the central processing unit 61. The A to D conversion process is initiated on command from the central processing unit 61 which selects the input channel to be converted. The read only memory 63 contains the program for operating the central processing unit 61 and further contains appropriate data in look-up tables used in calculating appropriate values for fuel delivery requirements and ignition-system spark timing. Control words specifying desired fuel delivery requirements and ignition-system spark timing are periodically transferred by the central processing unit 61 to the fuel-injection and spark-timing control circuits included in the input/output control circuit 64. The fuel injection control circuit converts the received control work into a fuel injection pulse signal Si for application to a power transistor 66. The power transistor 66 connects the fuel injector 40 to the engine battery 70 for a time period determined by the width of the fuel injection control pulse signal Si. The spark timing control circuit converts the received control word into a spark timing control pulse signal Sp for application to a power transistor 68. The power transistor 68 connects the ignition coil 26 to the engine battery 70 for a time period determined by the width of the spark timing control pulse signal Sp.

The ignition system includes a distributor 28 connected with the ignition coil 26 to energize the spark plugs 24 of the engine. For this purpose, the ignition coil 26 has a primary winding connected across the engine battery 70 through the power transistor 68. The ignition coil 26 has a high voltage terminal connected to a rotor 28*a* of the distributor 28. The rotor 28*a* is driven at one-half the rotational velocity of the crankshaft 16. The distributor 28 has electrical contacts 28*b* each of which is connected in the usual manner by separate electrical leads to the spark plugs 24 of the engine. As the distributor rotor 28*a* rotates, it sequentially contacts the electrical contacts 28*b* to permit high voltage electrical energy to be supplied at appropriate intervals to the spark plugs 24, causing sparks to be generated across the gaps 24*a*, 24*b*, 24*c* and 24*d* of the respective spark plugs 24. The distributor 28 does not control ignition-system spark timing. Rather, spark timing is an independently controlled variable calculated through the use of the digital computer in a manner hereinafter described. It should be understood that the illustrated four cylinder engine is shown and described only to facilitate a more complete understanding of the engine control system embodying the invention.

Figure 3:
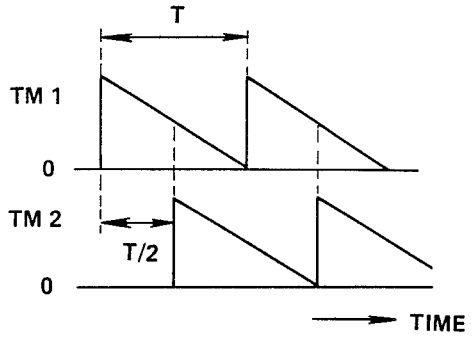
FIG. 3 contains two waveforms used in explaining the operation of the first and second conters used in the control unit of FIG. 2.

The input/output control circuit 64 includes first and second counters TM1 and TM2 and a register TREC used for determining the first interval during which fuel delivery to the first cylinder group is terminated under an overspeed condition and the second interval during which fuel delivery to the second cylinder group is terminated under an overspeed condition. The first counter TM1 has a predetermined value T set thereon at uniform intervals when its count decreases to zero under an overspeed condition. The first counter TM1 counts down by one step from the value T toward zero at uniform intervals, as shown in FIG. 3. Similarly, the second timer TM2 has the predetermined value T set thereon when the count of the first counter TM1 decreases to a value T/2, as shown in FIG. 3. The second counter TM2 counts down by one step from the value T toward zero at uniform intervals, as shown in FIG. 3. Thus, the time at which the predetermined value T is set on the first counter TM1 is deviated at time corresponding to an interval T/2 from the time at which the predetermined value T is set on the second counter TM2.

Figure 4:
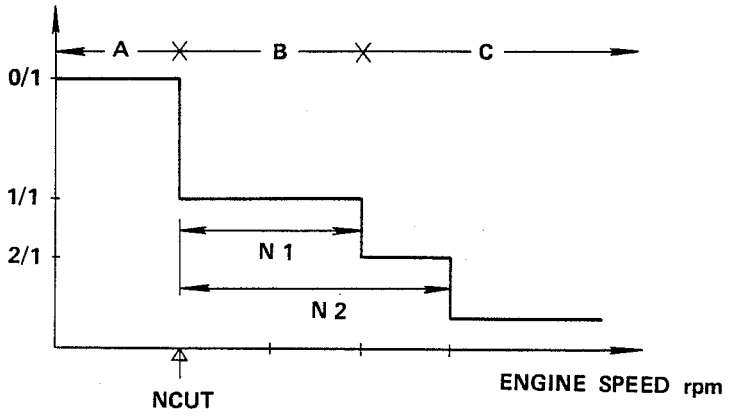
FIG. 4 is a diagram showing different fuelcut intervals in connection with different engine speeds.

The register TREC latches a predetermined first value T1 when the existing overspeed, which corresponds to a difference of a predetermined upper limit (fuelcut speed) from the existing engine speed, is equal to or less than a first reference value N1. The register TREC latches a predetermined second, greater value T2 when the existing overspeed is smaller than the first reference value N1. For example, the predetermined first value T1 may be one-hair of the interval T during which the first and second counters count down from the value T to zero, whereas the predetermined second value T2 may be one-third of the interval T, as shown in FIG. 4 where the abscissae represent the engine speeds and the ordinates represent the ratios of the interval during which the engine operates in a fuelcut mode to the interval during which the engine operates in a normal mode. In FIG. 4, the character A indicates a region where the control unit operates all of the cylinders in a normal fashion, the character B indicates a region where the control unit terminates the fuel delivery to the first and second cylinder groups alternatively, the character C indicates a region where the control unit terminates the fuel delivery to all of the cylinders, and the character NCUT indicates a predetermined upper limit (fuelcut speed).

Figure 5:
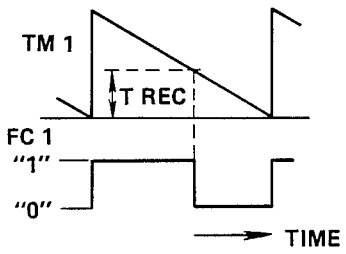
FIG. 5 contains two waveforms used in explaining the manner to determine the fuelcut interval.

When the count of the first counter TM1 is greater than the value latched in the register TREC, a flag FC1 is set to indicate that the fuel delivery to the first cylinder group should be terminated, as shown in FIG. 5. Similarly, a second flag FC2 is set to indicate that the fuel delivery to the second cylinder group should be terminated when the count of the second counter TM2 is greater than the value latched in the register TREC.

Figure 6:
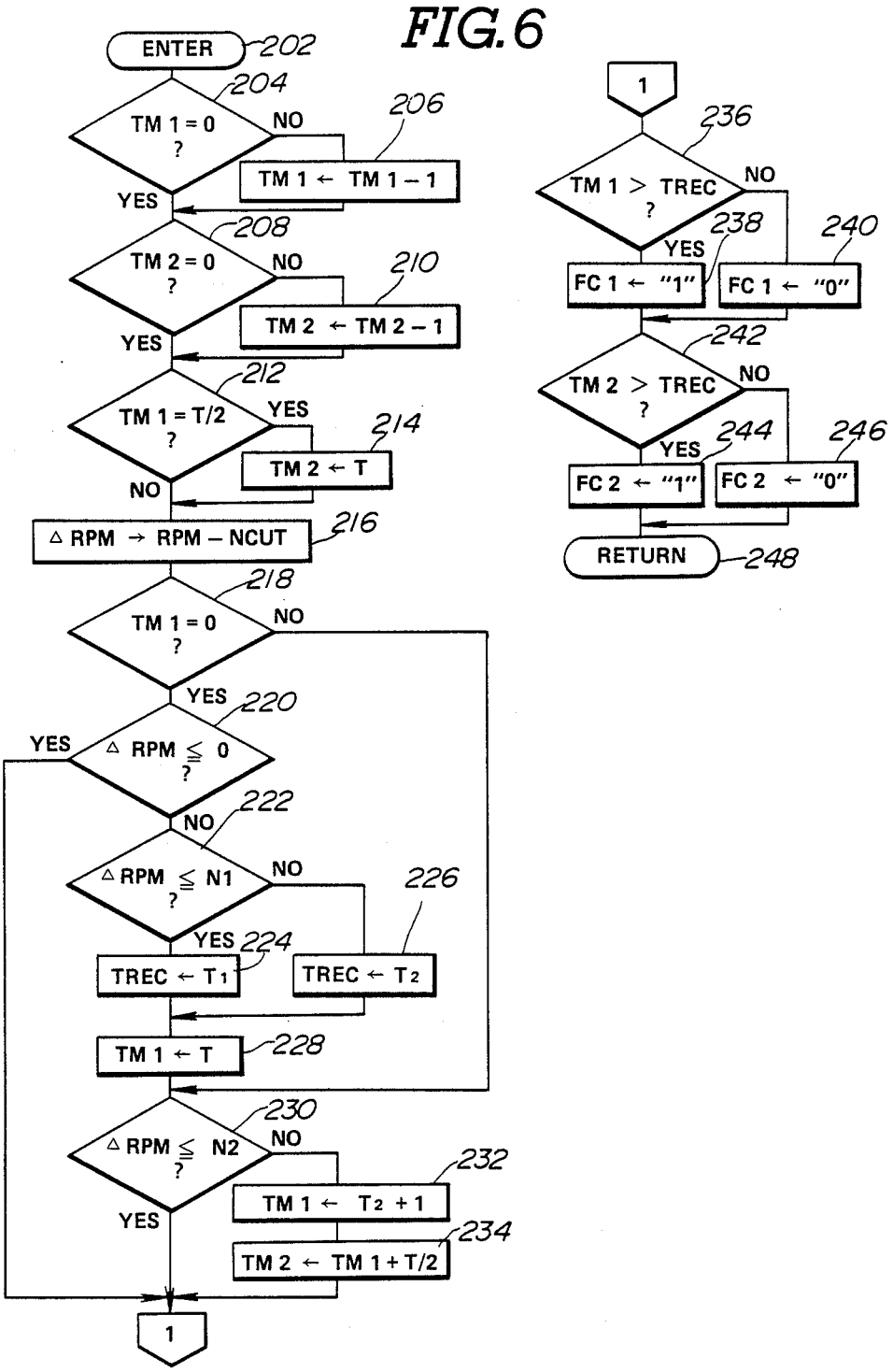
FIG. 6 is a flow diagram of the programming of the digital computer as it is used to determine the fuelcut interval in a fuelcut mode of operation.

FIG. 6 is a flow diagram illustrating the programming of the digital computer as it is used to determine the first and second intervals for the first and second cylinder groups.

The computer program is entered at the point 202 at uniform time intervals or at uniform intervals of rotation of the engine crankshaft. At the point 204 in the program, a determination is made as to whether or not the first counter TM1 indicates a zero count. If the answer to this question is "yes", then the program proceeds to the point 208. Otherwise, the program proceeds to the point 206 where the first counter TM1 is counted down by one step. Following this, the program proceeds to the point 208. Thus, the first counter TM1 counts down by one step at uniform intervals.

At the point 208 in the program, a determination is made as to whether or not the second counter TM2 has a zero count. If the answer to this question is "yes", then the program proceeds to the point 212. Otherwise, the program proceeds to the point 210 where the second counter TM1 is counted down by one step. Following this, the program proceeds to the point 212. Thus, the second counter TM2 counts down by one step at uniform intervals.

At the point 212 in the program, a determination is made as to whether or not the count of the first counter TM1 is equal to one-half of a prdetermined value T. If the answer to this question is "no", then the program proceeds to the point 216. Otherwise, the program proceeds to the point 214 where a predetermined value T is set on the second counter TM2. Following this, the program proceeds to the point 216. Thus, the second counter TM2 has a predetermined value T set thereon each time the count of the first counter TM1 decreases to one-half of the predetermined value T.

At the point 216 in the program, the central processing unit 61 calculates the existing overspeed value ΔRPM by subtracting a predetermined fuelcut speed value NCUT from the existing engine speed value N. At the point 218 in the program, a determination is made as to whether or not the first timer TM1 indicates a zero count. If the answer to this question is "yes", then the program proceeds to another determination step at the point 220. This determination is as to whether or not the calculated overspeed value RPM is equal or less than zero. If the answer to this question is "yes", then the program proceeds to the point 236. Otherwise, the program proceeds to another determination step at the point 222. This determination is as to whether or not the calculated overspeed value ΔRPM is equal to or less than a first reference value N1 (FIG. 4). If the answer to this question is "yes", then the program proceeds to the point 224 where a predetermined first value T1 is set on the register TREC and then proceeds to the point 228. Otherwise, the program proceeds to the point 226 where a predetermined second, smaller value T2 is set on the register TREC. Following this, the program proceeds to the point 228. The steps at these points serves to prolong the interval during which the engine operates in a fuelcut mode when the overspeed value ΔTPM is greater than the first reference value N1, as can be seen from FIG. 5.

At the point 228 in the program, the predetermined value T is set on the first counter TM1. At the following point 230, a determination is made as to whether or not the calculated overspeed value ΔRPM is equal to or less than a second reference value N2 (FIG. 4) that is greater than the first reference value N1. If the answer to this question is "yes", then the program proceeds to the point 236. Otherwise, the program proceeds to the point 232 where a value T2+1 is set on the first counter TM1 and then to the point 234 where a value T2+1+T/2 on the second counter TM2. The steps at these points serves to terminate the fuel delivery to both of the first and second groups when the overspeed value ΔRPM is greater than the second, greater reference value N2.

If the answer to the question inputted at the point 218 is "no", then the program proceeds to the point 230. Thus, the steps following the step at the point 230 are executed regardless of the fact that the first counter TM1 has a zero count. If the answer to the question inputted at the point 230 is "yes", then the program proceeds to the point 236.

At the point 236 in the program, a determination is made as to whether or not the count of the first counter TM1 is greater than the value latched on the register TREC. If the answer to this question is "yes", then the program proceeds to the point 238 where a first fuelcut flag FC1 is set to indicate that the fuel delivery to the first cylinder group should be terminated. Following this, the program proceeds to the point 242. Otherwise, the program proceeds from the point 236 to the point 240 where the first fuelcut flag FC1 is cleared to indicate that the fuel delivery to the first cylinder group should be restored. Following this, the program proceeds to the point 242.

At the point 242 in the program, a determination is made as to whether the count of the second counter TM2 is greater than the value latched on the register TREC. If the answer to this question is "yes", then the program proceeds to the point 244 where a second fuelcut flag FC2 is set to indicate that the fuel delivery to the second cylinder group should be terminated. Following this, the program proceeds to the end point 248. Otherwise, the program proceeds from the point 242 to the point 246 where the second fuelcut flag FC2 is cleared to indicate that the fuel delivery to the second cylinder group should be restored. Following this, the program proceeds to the end point 248.

Figure 7:
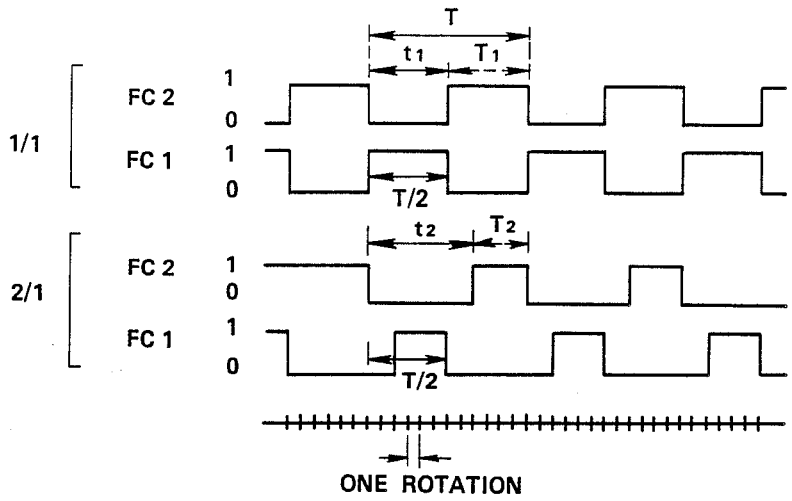
FIG. 7 contains several waveforms used in explaining different two fuelcut intervals selected according to engine speed.

As shown in FIG. 7, the interval T is divided into an interval during which the first or second fuelcut flag is set and an interval during which the first or second fuelcut flag is cleared. The former interval is equal to the latter interval when the predetermined value T1 latched in the register TREC is one-half of the interval T, whereas the former interval is twice as long as the latter interval when the predetermined value T2 latched in the register TREC is one-third of the interval T. It is apparent from a study of FIG. 7 that there is no case where the interval during which the first fuelcut flag is cleared and the interval during which the second fuelcut flag FC2 is cleared overlap each other.

Figure 8:
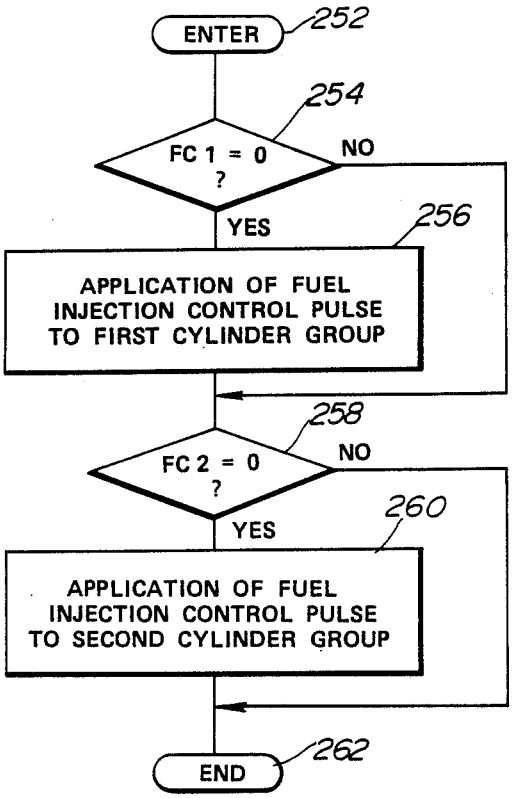
FIG. 8 is a flow diagram of the programming of the digital computer as it is used to control the fuel delivery to the engine.

FIG. 8 is a flow diagram illustrating the programming of the digital computer as it is used to control the fuel delivery to the engine.

The computer program is entered at the point 252 at uniform intervals of rotation of the engine crankshaft. At the point 254 in the program, a determination is made as to whether or not the first fuelcut flag FC1 is cleared. If the answer to this question is "yes", then the program proceeds to the point 256 where the calculated value for fuel-injection pulse-width is transferred into the fuel-injection control circuit included in the input-/output control circuit 64. Thus, a fuel-injection control pulse is supplied to restore the fuel delivery to the first cylinder group at a particular angular point in the rotation of the engine crankshaft. Following this, the program proceeds to the point 258. If the first fuelcut flag FC1 is set, then the program proceeds from the point 254 directly to the point 258. Thus, no fuel-injection control pulse is produced from the fuel-injection control circuit so as to terminate the fuel delivery to the first cylinder group.

At the point 258 in the program, a determination is made as to where or not the second fuelcut flag FC2 is cleared. If the answer to this question is "yes", then the program proceeds to the point 260 where the calculated value for fuel-injection pulse-width is transferred into the fuel-injection control circuit included in the input-/output control circuit 64. Thus, a fuel-injection control pulse is supplied to restore the fuel delivery to the second cylinder group at a particular angular point in the rotation of the engine crankshaft. Following this, the program proceeds to the end point 262. If the second fuelcut flag FC2 is set, then the program proceeds from the point 242 directly to the end point 262. Thus, no fuel-injection control pulse is produced from the fuel-injection control circuit so as to terminate the fuel delivery to the second cylinder group.

Figure 9:
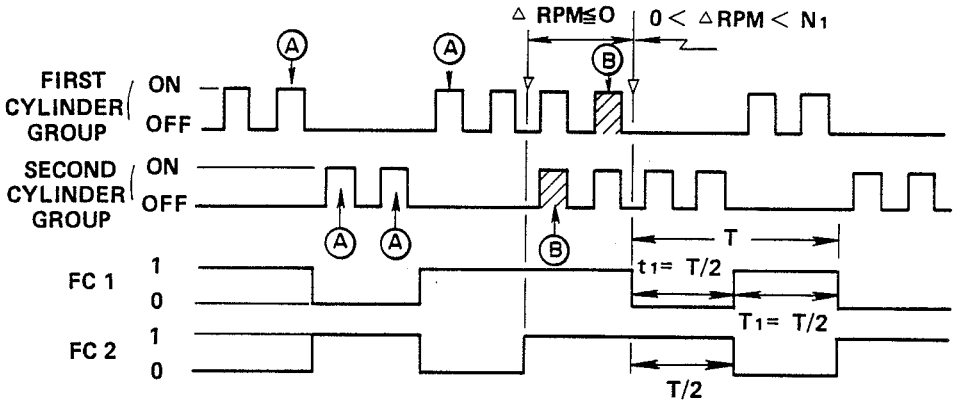
FIG. 9 contains several waveforms used in explaining the operation of the fuel delivery control apparatus of the invention.

According to the invention, the fuel delivery control circuit operates the engine in a fuelcut mode under an overspeed condition. During the fuelcut mode of operation of the engine, the interval during which the fuel delivery to the first cylinder group is terminated is shifted a predetermined value with respect to the interval during which the fuel delivery to the second cylinder group is terminated so that the control circuit alternatively terminates the fuel delivery to the first cylinder group and the fuel delivery to the second cylinder group. This is effective to operate the engine with almost no temperature difference between the first and second cylinder groups. Although there is a tendency toward misfire in the cylinders when fuel injection is initiated at the start or end of the fuelcut interval, as indicated by the characters A and B in FIG. 9, the resulting influence is much smaller than in conventional apparatus. The reason for this is that the fuel delivery to one of the first and second cylinders is terminated when misfire occurs in one or two cylinders included in the other cylinder group, as indicated by the character A. Thus, the unburned fuel components discharged from the other cylinder group cannot react violently to the components discharged from the one cylinder group. In addition, misfire, indicated by the character B, cannot occur in two or more cylinders in one of the first and second cylinder groups.

What is claimed is:

1. An apparatus for controlling a multi-cylinder type internal combustion engine including first and second cylinder groups each including at least one cylinder, comprising:

sensor means for generating electrical signals indicative of engine operating conditions including engine speed;

a control circuit coupled to said sensor means for calculating an appropriate value repetitively at uniform intervals, the calculation being made according to engine operating conditions;

fuel supply means coupled to said control circuit for supplying fuel to said first and second cylinder groups in an amount corresponding to the calculated value;

said control circuit including means responsive to an overspeed condition for operating said fuel supply means in a fuelcut mode to alternatively terminate fuel delivery to said first cylinder group and fuel delivery to said second cylinder group, means for calculating a difference of a predetermined fuelcut speed value from an existing engine speed, and means for determining the overspeed condition when the calculated difference is greater than zero, said control circuit including means for setting a value of a first interval during which said fuel supply means operates in the fuelcut mode according to the calculated difference.

2. The apparatus as claimed in claim 1, wherein the control circuit includes means for setting the first interval at a first value when the calculated difference is equal to or less than a first reference value and at a second value greater than the first value when the calculated difference is greater than the first reference value.

3. The apparatus as claimed in claim 2, wherein the control circuit includes means for operating the fuel supply means to terminate fuel delivery to both of the first and second cylinder groups when the calculated difference is greater than a second reference value greater than the first reference value.

4. An apparatus for controlling a multi-cylinder type internal combustion engine including first and second cylinder groups each including at least one cylinder, comprising:

sensor means for generating electrical signals indicative of engine operating conditions including engine speed;

a control circuit coupled to said sensor means for calculating an appropriate value respectively at uniform intervals, the calculation being made according to engine operating conditions;

fuel supply means coupled to said control circuit for supplying fuel to said first and second cylinder groups in an amount corresponding to the calculated value;

said control circuit including means responsive to an overspeed condition for operating said fuel supply means in a fuelcut mode to alternatively terminate fuel delivery to said first cylinder group and fuel delivery to said second cylinder group, means for calculating a difference of a predetermined fuelcut speed value from an existing engine speed, and means for determining the overspeed condition when the calculated difference is greater than zero said control circuit including means for determining a first interval during which said fuel supply means operates in the fuelcut mode to terminate fuel delivery to said first cylinder group according to the calculated difference, said control circuit including means for determining a second interval during which said fuel supply means operates in the fuelcut mode to terminate fuel delivery to said second cylinder group according to the calculated difference, the second interval being shifted a predetermined value with respect to the first interval to avoid overlap of the first and second intervals.

5. The apparatus as claimed in claim 4, wherein the control circuit includes means for setting the first and second intervals at a first value when the calculated difference is equal to or less than a first reference value and at a second value greater than the first value when the calculated difference is greater than the first reference value.

6. The apparatus as claimed in claim 5, wherein the control circuit includes means operating the fuel supply means to terminate fuel delivery to both of the first and second cylinder groups when the calculated difference is greater than a second reference value greater than the first reference value.

* * * * *